US012187519B2

(12) United States Patent
Nugent

(10) Patent No.: US 12,187,519 B2
(45) Date of Patent: Jan. 7, 2025

(54) EDGE PROTECTOR WITH EXTENDED ADHESIVE TOP LAYER AND RELEASE LINER

(71) Applicant: Great Northern Corporation, Appleton, WI (US)

(72) Inventor: Corey D. Nugent, Appleton, WI (US)

(73) Assignee: Great Northern Corporation, Appleton, WI (US)

( * ) Notice: Subject to any disclaimer, the term of this patent is extended or adjusted under 35 U.S.C. 154(b) by 1147 days.

(21) Appl. No.: 17/024,943

(22) Filed: Sep. 18, 2020

(65) Prior Publication Data

US 2021/0086974 A1 Mar. 25, 2021

Related U.S. Application Data

(60) Provisional application No. 62/903,041, filed on Sep. 20, 2019.

(51) Int. Cl.
*B65D 81/05* (2006.01)

(52) U.S. Cl.
CPC ..... *B65D 81/054* (2013.01); *B65D 2581/053* (2013.01)

(58) Field of Classification Search
CPC ..... B65D 81/054; B65D 2581/053
See application file for complete search history.

(56) References Cited

U.S. PATENT DOCUMENTS

| | | | | | |
|---|---|---|---|---|---|
| 1,852,832 | A * | 4/1932 | Beaman | B65D 81/054 | 206/586 |
| 2,950,038 | A * | 8/1960 | Rupp | B65D 5/5033 | 206/521 |
| 3,109,207 | A | 11/1963 | Cooper | | |
| 3,200,547 | A | 8/1965 | Johnson | | |
| 3,337,111 | A * | 8/1967 | Petriekis | B65D 5/5033 | 217/52 |
| 3,368,736 | A * | 2/1968 | McKellick | B65D 5/445 | 229/199 |
| 5,181,611 | A * | 1/1993 | Liebel | B65D 71/04 | 206/453 |
| 5,749,512 | A | 5/1998 | Gingras-Taylor | | |
| 6,224,955 | B1 | 5/2001 | Gorski | | |
| 7,111,734 | B2 * | 9/2006 | Robinson, Jr. | B65D 81/054 | 206/453 |
| 7,299,924 | B2 * | 11/2007 | Robinson, Jr. | B65D 81/054 | 206/453 |
| 8,342,334 | B2 * | 1/2013 | Leibreich | B65D 81/054 | 206/586 |
| 11,794,458 | B2 * | 10/2023 | Begrow | B31D 5/006 | |

(Continued)

*Primary Examiner* — Patricia L. Nordmeyer
(74) *Attorney, Agent, or Firm* — Andrus Intellectual Property Law, LLP

(57) ABSTRACT

An edge protector including a main body for installation on a box or package for protection and reinforcement. The edge protector includes first and second legs and a cover layer that extends over the outer surface of both of the first and second legs. An attachment portion of the cover layer extends over the outer edge of each leg and is retained along an inner surface of the leg on a release liner. During use, the attachment portions are both released from the release liner on the inner surface of the first and second legs such that an adhesive on the attachment portion can be used to attach the edge protector to a package or product.

10 Claims, 8 Drawing Sheets

(56) References Cited

U.S. PATENT DOCUMENTS

| | | | | |
|---|---|---|---|---|
| 2005/0087663 | A1* | 4/2005 | Schroeder | B65D 81/054 206/586 |
| 2006/0283115 | A1 | 12/2006 | Robertson | |
| 2007/0003726 | A1 | 1/2007 | Swannell | |
| 2012/0000815 | A1* | 1/2012 | Butch, Jr. | B65D 81/054 206/453 |
| 2014/0069842 | A1* | 3/2014 | D'Anglade | B31D 3/04 493/128 |
| 2019/0270570 | A1* | 9/2019 | Jette | B65D 81/054 |

* cited by examiner

EDGE PROTECTOR WITH EXTENDED ADHESIVE TOP LAYER AND RELEASE LINER

BACKGROUND OF THE INVENTION

The present disclosure generally relates to elongated edge protector for protecting an edge or corner of an item or items being shipped or transported. More specifically, the present disclosure relates to elongated, V-shaped edge protectors that includes an adhesive backed cover layer having a pair of attachment portions that each extend from one of the legs of the edge protector to permit attachment of the edge protectors to a box or product container.

Packages, articles, products, palletized loads and the like are often subject to damage during shipping or transit. The traditional method of shipping a product, such as a large appliance, involves packaging the product within a cardboard box having cardboard inserts for positioning and holding the product within the box. After each product is packaged within a box, multiple boxes are assembled into an orderly stack onto a pallet or shipping crate. Once the boxed products are assembled onto the pallet, the stack of boxed products are typically wrapped in a heat shrinkable plastic sheet to maintain the integrity of the assembled stack.

During shipment and storage, the corner edges of the outer boxes in the stack of boxes may become damaged. Thus, edge protectors are often used along the outside corners of the assembled stack. Edge or corner protectors are typically formed from one or more pieces of paperboard, cardboard and/or corrugated cardboard folded into a rigid V-shape member having a pair of transversely oriented legs joined at a generally curved apex.

Although the edge protectors can be manually held in place as the heat shrinkable plastic sheet is wrapped around the assembled stack, it is desirable to provide an edge protector that is self-adhering to facilitate the packaging process. Although a self-adhering edge protector is desirable, the edge protectors must also be stackable for storage prior to use.

Presently, edge protectors are available that include an adhesive material positioned on the inside surface of both legs of the edge protector. U.S. Patent Application Publication No. 2007/0003726 shows one example of such edge protector. When such an edge protector is to be used, both legs of the edge protector are attached to the assembled stack of products or to each product separately.

It is desirable to provide an edge protector that can be stored and stacked and includes an attachment section that extends from each of the legs of the edge protector. It is desirable to provide such a V-shaped edge protector such that the edge protector can be mounted to a product or group of products.

SUMMARY OF THE INVENTION

The present disclosure is an edge protector for protecting an edge or corner of an article or multiple stacked articles. The edge protector includes a cover layer having extended attachment portions that include adhesive such that the edge protector can be self-supported along the article being protected.

The edge protector includes a main body that is defined by a first leg and a second leg joined to each other. Each of the first and second legs includes both an inside face surface and an outside face surface. The main body extends from a first end to a second end.

In one embodiment of the disclosure, the main body of the edge protector is formed from a plurality of layers of paperboard plies each laminated together. However, it is contemplated that the edge protector could also be formed from other materials, such as plastic. A cover layer is applied to the main body and includes an adhesive on the inner surface of the cover layer. The adhesive on the inner surface of the cover layer attaches the cover layer to the outer surface of the main body. The cover layer includes attachment portions that wrap around the outer edge of the main body. Each of the attachment portion is received on a release liner that is attached to the inner surface of the main body along each leg of the main body. The attachment portions can be selectively removed from the release liner and moved to an attachment position where the attachment portion extends past the outer edge of the main body. In this position, the attachment portions can be used to secure the edge protector to the corner or edge of a product that needs protection. The adhesive applied to the inner surface of each attachment portions allows the edge protector to be self-supported on the product being protected.

In an exemplary embodiment of the present disclosure, each of the attachment portions includes a release tab. The release tab is formed as a portion of the release liner that does not include adhesive holding it to the main body. The release tab is separated from the remaining portion of the release liner by a score line. When the attachment portion is moved to the attachment position, the portion of the release liner without the adhesive and defined by the score line separates from the rest of the release liner to aid in removal of the attachment portion. In an alternate embodiment, a release coating can be applied to the adhesive along the release tab to render the adhesive ineffective.

In accordance with a method of the present disclosure, one or more V-shaped edge protectors are provided that each have a main body including a generally right-angle cross section defined by a first leg and a second leg joined at an apex. A release liner is attached along a portion of the inner surface of the main body in close proximity to an outer edge of each of the first and second legs.

Once the release liners are attached, a cover layer is attached to the outer surface of the main body. The cover layer includes an adhesive applied to the inner surface of the cover layer. The cover layer is formed with a pair of attachment portions that each extend around the outer edges of the first and second legs and are positioned in contact with one of the release liners.

When the edge protector is to be applied, the attachment portions are peeled from the release liners such that the attachment portions extend past the outer edges. Since the attachment portions include the adhesive, the attachment portions can be used to support the edge protector on a product or stack of products. When the edge protector is positioned as desired, the attachment portions are pressed into contact with the product such that the adhesive on the attachment portion can hold the edge protector in place.

BRIEF DESCRIPTION OF THE DRAWINGS

The drawings illustrate the best mode presently contemplated from carrying out the invention in drawings.

DETAILED DESCRIPTION OF THE INVENTION

Figure 1:
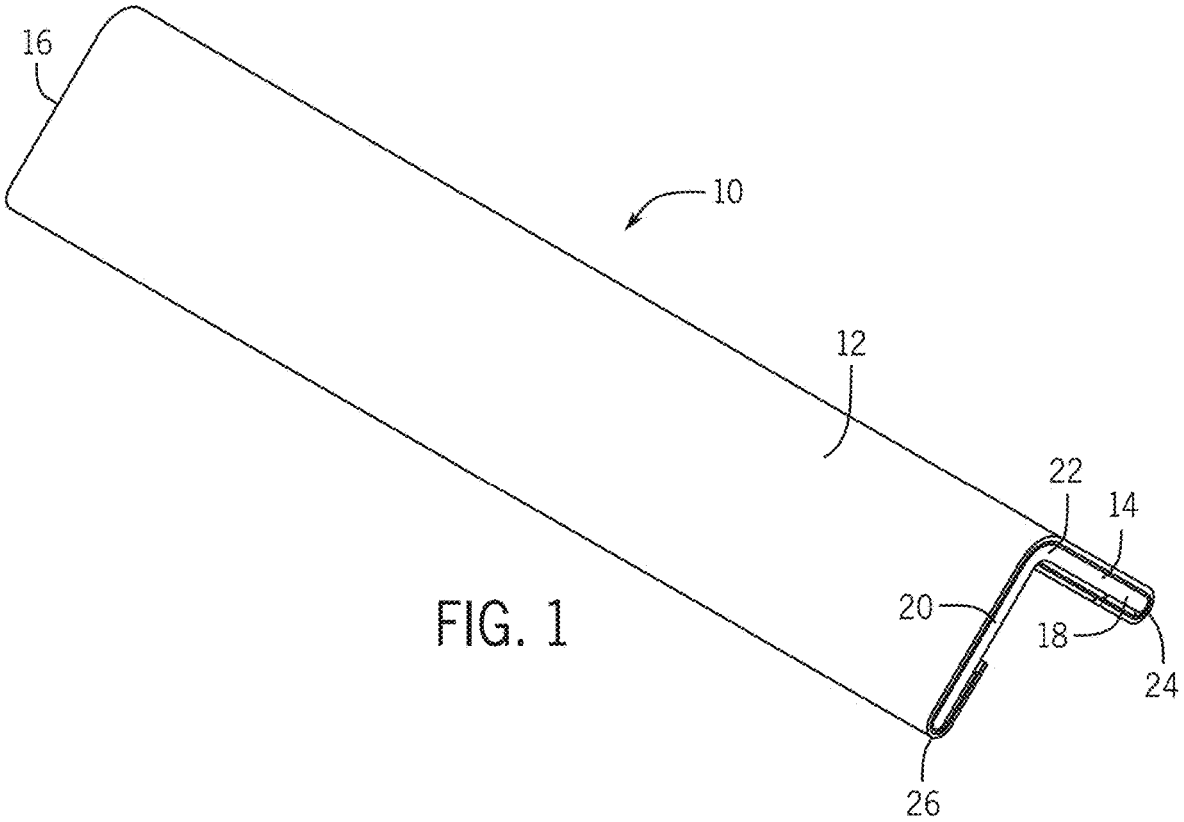
FIG. 1 is a perspective view of the edge protector of the present disclosure.

FIG. 1 illustrates an edge protector 10 constructed in accordance with the present disclosure. The edge protector 10 includes a main body 12 that extends between a first end 14 and a second end 16. The main body 12 has a generally 90° right angle cross section formed by a first leg 18 and a second leg 20 joined to each other along an apex 22. The first leg 18 extends from the apex 22 to an outer edge 24 while the second leg 20 extends from the apex 22 to an outer edge 26. The main body 12, including the first and second legs 18, 20, is preferably formed from a plurality of paperboard plies laminated together and formed into the generally V-shaped right-angle configuration shown in FIG. 1. However, it is contemplated that the main body could be formed from other materials, such as corrugated cardboard, plastic, chipboard, recycled pulp or other similar materials. In addition to the V-shaped profile, other types of edge protectors, such a U-shaped channel, could be utilized with the subject matter of the present disclosure. The manufacture and creation of the main body of the right-angle edge protector is well known in the industry.

Figure 2:
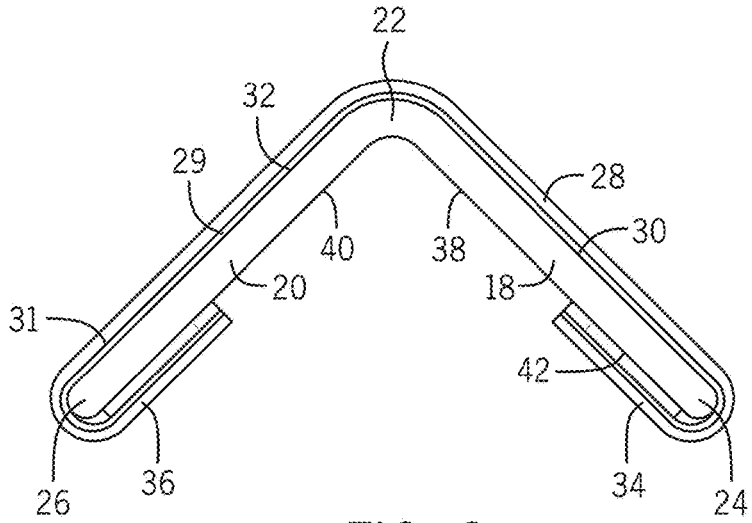
FIG. 2 is an end view of the edge protector.

As illustrated in FIGS. 1 and 2, in accordance with the present disclosure, a cover layer 28 is applied over the outer face 30 of the first leg 18 and the outer face 32 of the second leg 20 and passes over the apex 22. The cover layer 28 can be formed from different types of material, such as paper, plastic or similar materials. The cover layer 28 includes an adhesive 29 along the inner surface 31 such that the cover layer 28 is adhesively attached to the outer face surface of the main body. The cover layer 28 wraps over the outer edge 24 of the first leg 18 and the outer edge 26 of the second leg 20 to create a first attachment portion 34 and a second attachment portion 36. The first attachment portion 34 overlays a portion of the inner face surface 38 of the first leg 18 while the second attachment portion 36 overlays a portion of the inner face surface 40 of the second leg 20. Both of the first and second attachment portions 34 and 36 of the cover layer 28 include the adhesive.

Figure 3:
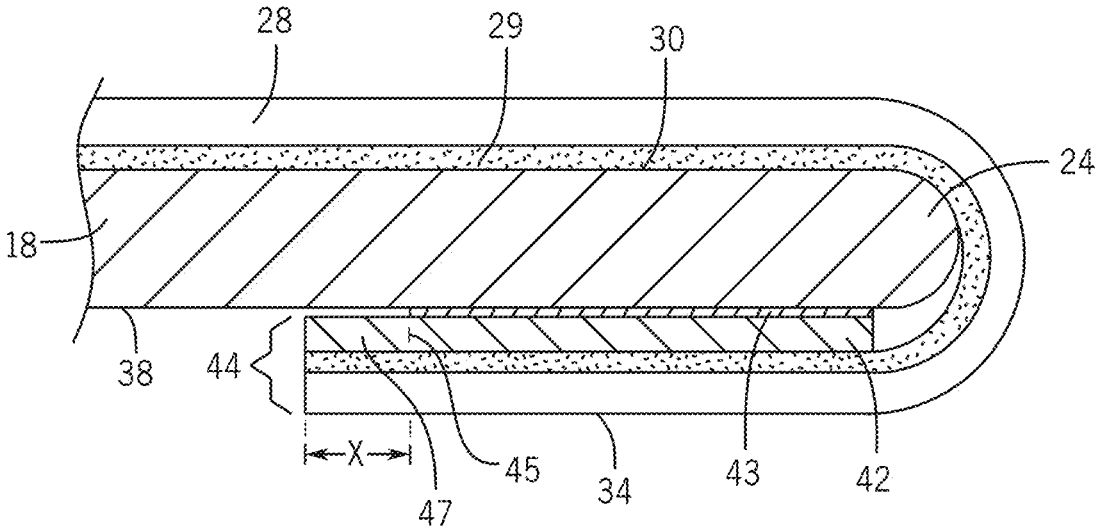
FIG. 3 is a section view of one of the legs of the edge protector.

Referring now to FIG. 3, a section view of the first leg 18 is thereshown. As illustrated, the cover layer 28 is securely attached to the outer face 30 of the first leg by the adhesive 29 such that the cover layer 28 is securely held in place along the entire outer face 30 and the outer edge 24. In the embodiment illustrated, a release liner 42 is adhesively attached by a layer of adhesive 43 to the inner face 38 at a location near the outer edge 24. The release liner 42 and the layer of adhesive are formed from materials that allow the adhesive 29 on the attachment portion 34 of the cover layer 28 to be separated from the release liner 42 while the release liner remains attached to the main body when desired. In the embodiment shown, a release tab 44 is formed as a portion of the release liner 42 that does not include the layer of adhesive 43. The release tab 44 has a dimension shown by the distance X. The release tab 44 creates a section of the attachment portion 34 that can be grasped by a user to pull the attachment portion 34 away from the rest of the release liner 42 during use as will be described in greater detail below. In the embodiment shown, the layer of adhesive 43 is not present along the inner surface of the release liner 42 at the release tab 44 or includes a coating that renders the adhesive ineffective.

In the embodiment shown, a score line 45 is formed in the release liner 42 to define the release tab 44. The score line 45 is generally aligned with end of the layer of adhesive 43. The score line 45 aids in separating a tab portion 47 of the release liner 42 from the remaining portion of the release liner 42. The remaining portion of the release liner 42 stays attached to the inner face 38 when the attachment portion 34 is removed from the release liner 42. Although a score line 45 is shown in the drawings, the score line 45 could be removed or replaced with another similar element, such as a line of perforations.

FIGS. 1 and 2 show the edge protector 10 in the storage condition in which the adhesive on each of the first and second attachment portions are place in contact with one of the release liners. In the storage condition, the edge protectors 10 can be stacked on top of each other and can easily be separated when needed since none of the adhesive is exposed.

Figure 5:
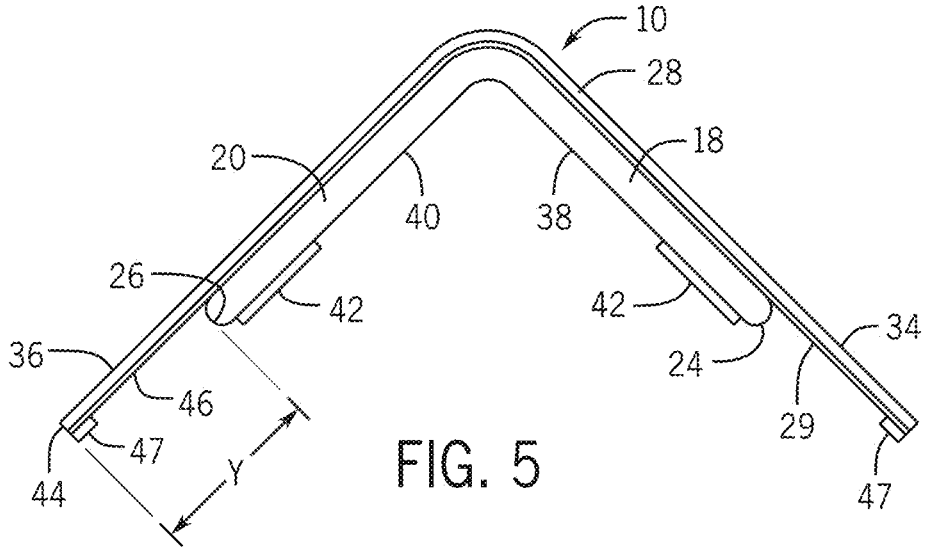
FIG. 5 is an end view of the edge protector shown in FIG. 4.
Figure 4:
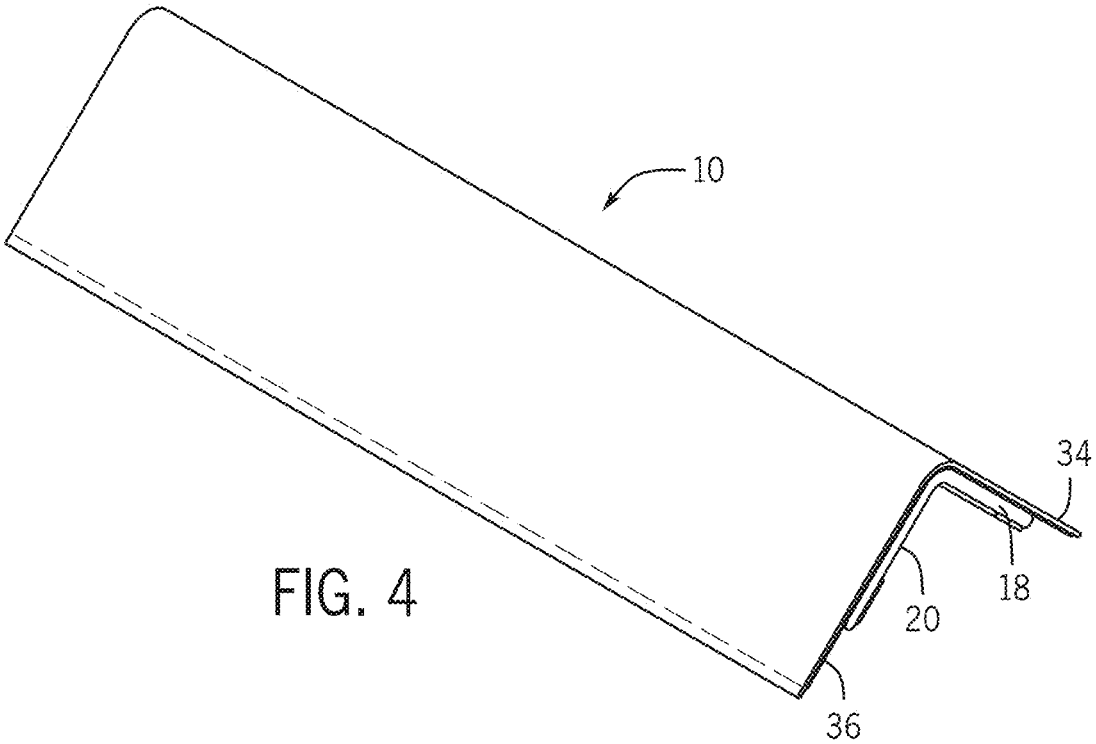
FIG. 4 is a perspective view similar to FIG. 1 in which the first and second attachment portions are in the attachment condition.

When a user wishes to attach the edge protector 10 of the present disclosure to an article, the user first grasps the release tabs 44 and pulls the attachment portions 34, 36 away from the release liners 42 attached to the first and second legs 18, 20, as shown in FIGS. 4 and 5. The tab portion 47 remains attached to the cover layer 28 while the rest of the release liner 42 stays on the first and second legs 18, 20. The attachment portions 34, 36 extend a length Y from the respective outer edges 24, 26 of the first and second legs 18, 20. When the attachment portions 34, 36 have been removed, the edge protector is in the attachment condition. In this condition, the release liner 42 remains attached to the inner surface, 38, 40 of the first and second legs 18, 20. Both of the first and second attachment portions 34, 36 include the adhesive 29 applied to the inner surface 46. The adhesive 29 applied to the inner surface 46 initially holds the attachment portion in contact with one of the release liners 42. When the attachment portion 34, 36 has been separated as shown in FIG. 5, the adhesive along the inner surface 46 can be used to attach the edge protector 10 to a product.

Figure 6:
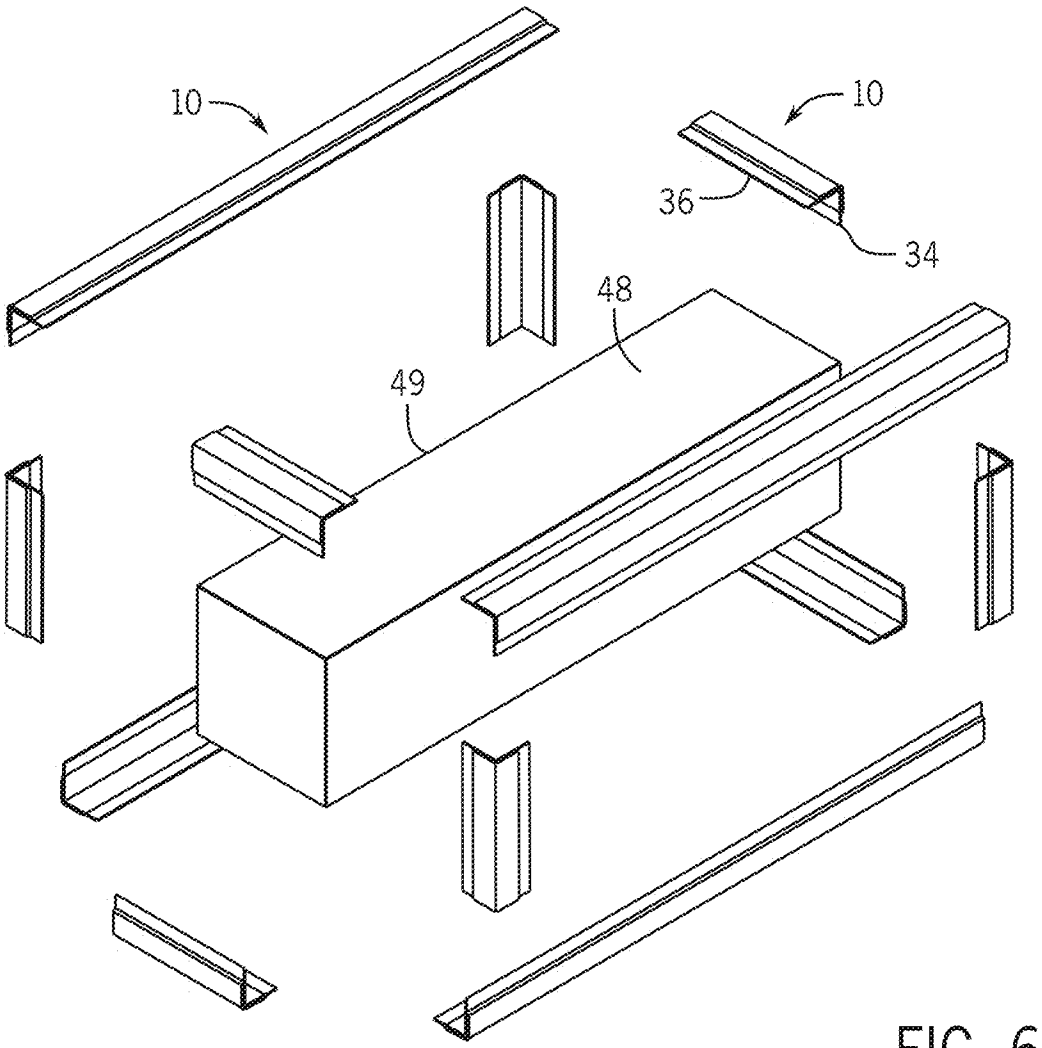
FIG. 6 is an exploded view of a package with a series of edge protectors positioned for installation.
Figure 7:
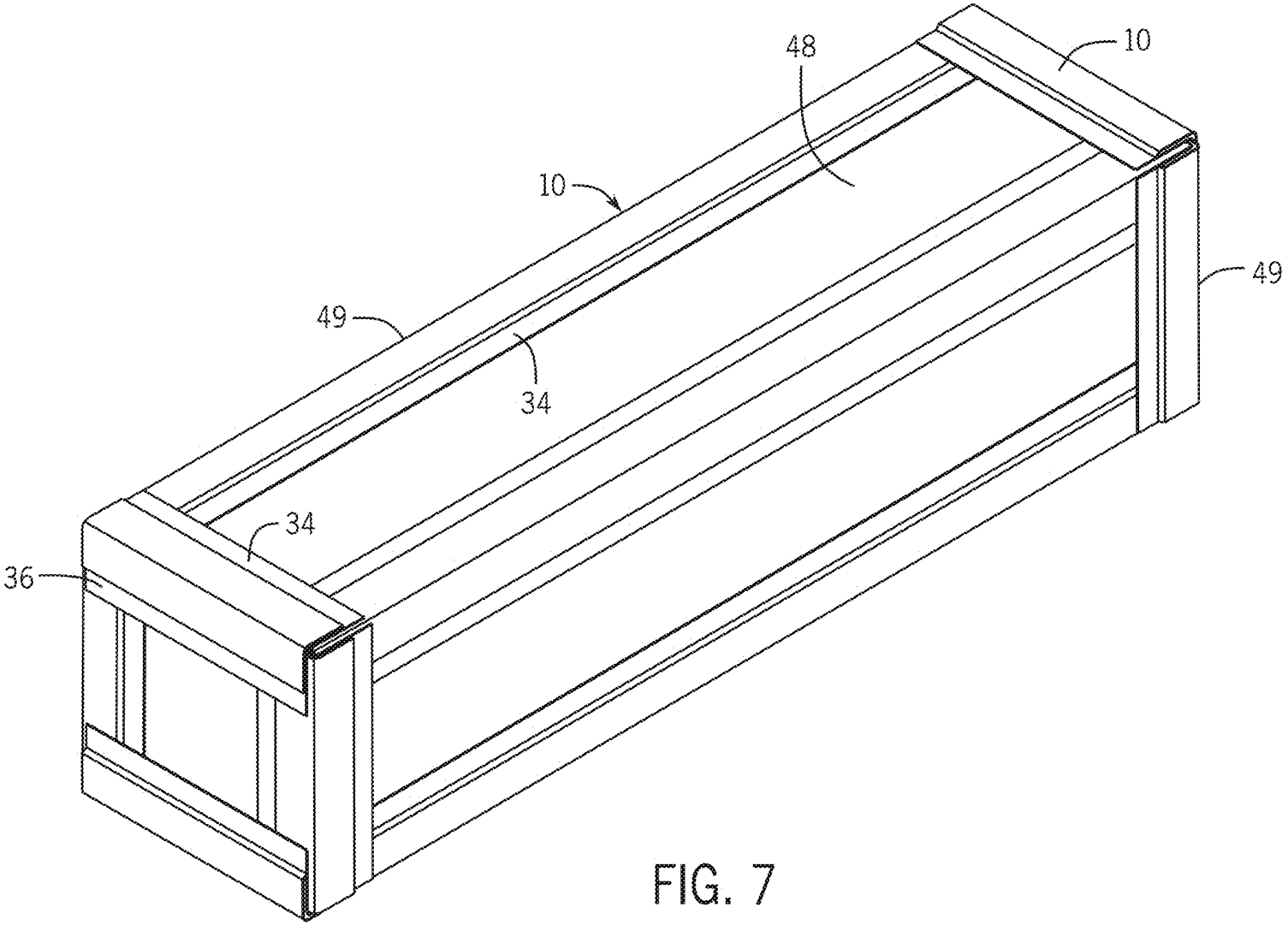
FIG. 7 is a view of a package with a series of edge protectors attached thereto.

As an illustrative example, FIG. 6 shows an elongated package 48 that is protected utilizing multiple sections of the edge protector 10 of the present disclosure. In the embodiment illustrated in FIG. 6, each outer edge surface 49 of the package 48 receives a section of the edge protector cut to the desired shape. In the condition shown in FIG. 6, each of the attachment portions 34, 36 have been separated from the release line such that the adhesive material formed along the attachment portion can be pressed into contact with the outer surface of the package. FIG. 7 illustrates the series of edge protectors 10 adhered to the package 48 such that each edge surface 49 and corner of the package is protected by one section of the edge protector 10.

In the embodiment shown in FIG. 3, the release liner 42 is shown along only a portion of the inner face 38 of each of the two legs 18, 20. However, it is contemplated that the release liner could be located between the entire cover layer 28 and the main body of the edge protector. In such an embodiment, when the first or second attachment portion 34, 36 is pulled away from the release liner, the user would need to ensure that the entire cover layer is not removed in undesired locations, such as along the outer face 30.

Figure 8:
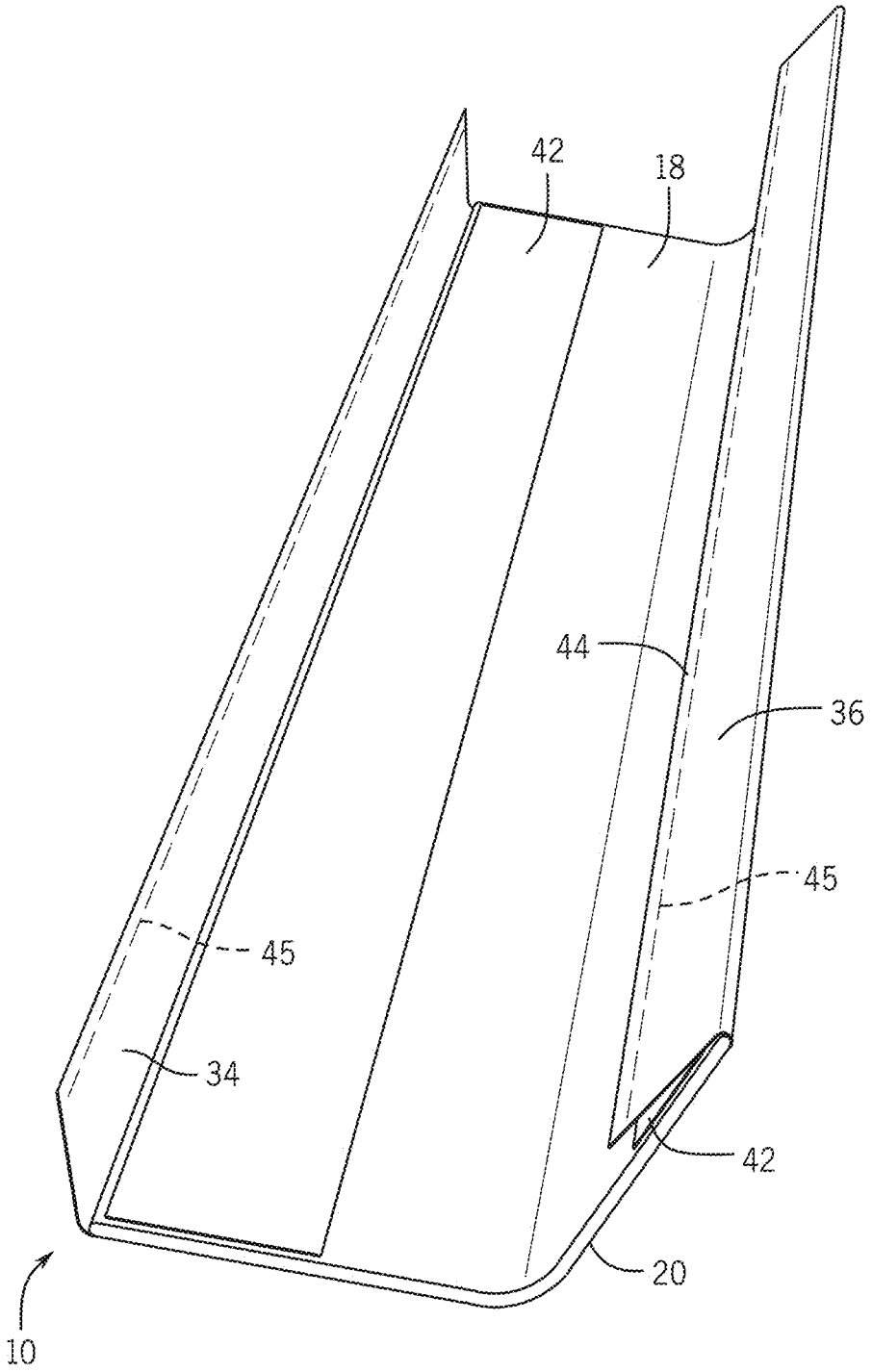
FIG. 8 is a view showing the edge protector of the present disclosure with one of the attachment portions in the attachment position and the other in the storage condition.

FIG. 8 is an illustration of the edge protector 10 in which the first attachment portion 34 has been separated from the release liner 42 while the second attachment portion 36 remains attached to the release liner.

Figure 9:
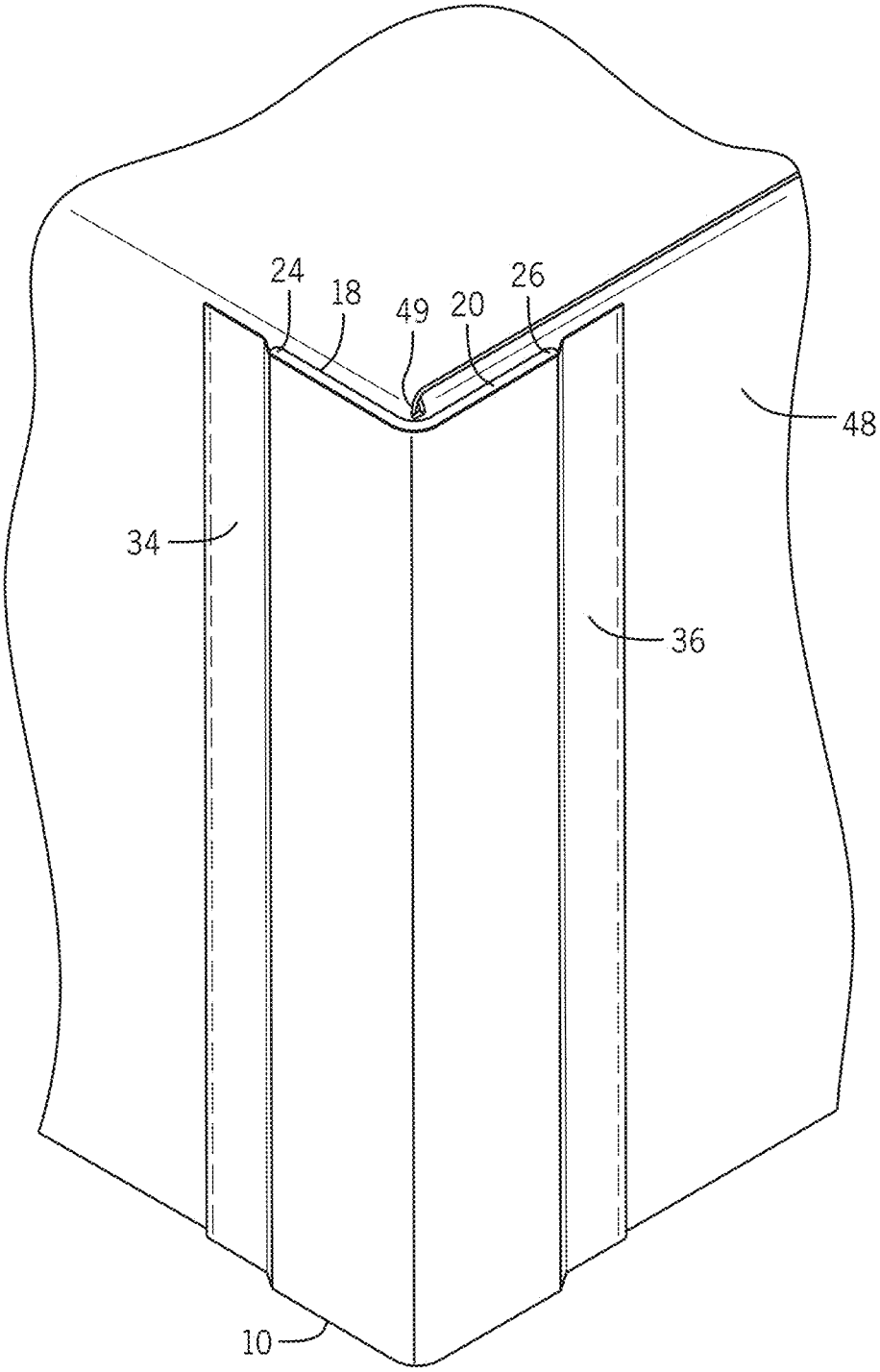
FIG. 9 is a magnified view showing the attachment of the edge protector to a product.

FIG. 9 is a magnified view showing the mounting of the edge protector 10 to and outer edge 49 of the package 48. As illustrated, the attachment portions 34 and 36 extend past the outer edges 24 and 26. The attachment portions 34 and 36 each include the adhesive that holds the edge protector 10 in place as shown.

Figure 10:
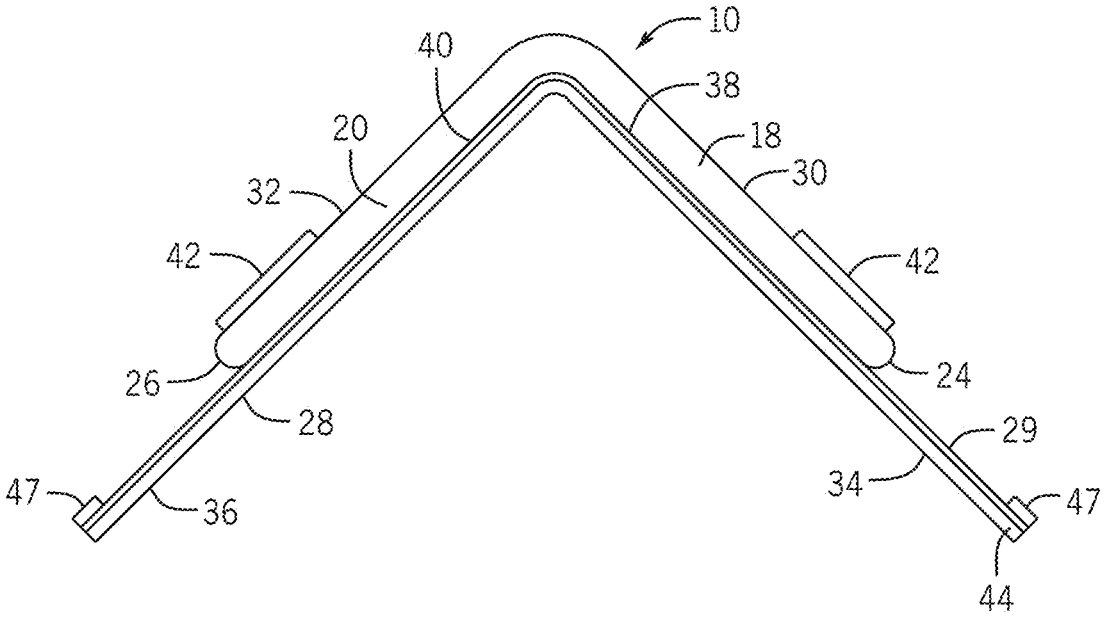
FIG. 10 is an end view of an alternate embodiment of the edge protector.

Although the embodiment of the edge protector 10 shown in the Figures is designed for use on an outer edge 49 of a package, it is contemplated that the edge protector 10 could be modified in accordance with the present disclosure for use on an inside corner of a package. In such an alternate embodiment shown in FIG. 10, the cover layer 28 is adhered along the entire inner face surfaces 38, 40 of the two legs 18 and 20. The two sections of the release liner 42 are adhesively attached to the outer face surfaces 30, 32 of each leg near each of the outer edges 24 and 26. In this alternate embodiment, the attachment portions 34 and 36 would wrap around the outer edges 24 and 26 and would be releasable attached to the sections of the release liners 42 in the same manner as described in the first embodiment. However, since the cover layer 28 in the second embodiment is attached to the inner face surface of the main body, the adhesive 29 on each of the attachment portions 34 and 36 faces outward. Such second embodiment would allow the edge protector to be adhered to protect an inner corner of a box or package.

Various alternatives and embodiments are contemplated as being within the scope of the following claims particularly pointing out and distinctly claiming the subject matter regarded as the invention.

What is claimed is:

1. An edge protector for using in protecting a product, comprising:

a main body including a first leg and a second leg, each of the first and second legs including an outer edge;

a release liner positioned along a portion of an inner surface of the main body in close proximity to the outer edge of both of the first and second legs; and a cover layer positioned on an outer surface of the main body, the cover layer having an adhesive on an inner surface of the cover layer;

wherein the cover layer includes first and second attachment portions that each extend around one of the outer edges of the first and second legs and are each received on one of the release liners positioned on the first and second legs.

2. The edge protector of claim 1 wherein each of the release liners includes a release tab.

3. The edge protector of claim 2 wherein a score line defines the release tab in the release liner such that the release tab of the release liner separates from the release liner along the score line and remains attached to the first or second attachment portion upon removal of the first or second attachment portion from the release liner.

4. The edge protector of claim 1 wherein the release liner includes a second adhesive on an inner surface of the release liner and the release tab is devoid of the second adhesive.

5. The edge protector of claim 1 wherein each of the first and second attachment portions are movable from a storage position in contact with the release liners and an attachment position in which the attachment portions extend parallel to the first and second legs.

6. The edge protector of claim 1 wherein the main body is formed from paperboard.

7. The edge protector of claim 1 wherein the main body has a V-shape and the first and second legs are joined at an apex.

8. The edge protector of claim 1 wherein the cover layer is formed from paper.

9. An edge protector for using in protecting a product, comprising:

a main body including a first leg and a second leg, each of the first and second legs including an outer edge;

a release liner positioned along a portion of an outer surface of the main body in close proximity to the outer edge of both of the first and second legs; and a cover layer positioned on an inner surface of the main body, the cover layer having an adhesive on an inner surface of the cover layer, wherein the cover layer includes first and second attachment portions that extend around the outer edges of the first and second legs and are received on the release liner on each of the first and second legs.

10. The edge protector of claim 9 wherein each of the first and second attachment portions are movable from a storage position in contact with the release liners to an attachment position in which the attachment portions extend parallel to the first and second legs.

* * * * *